US005157303A

United States Patent [19]

Polaert

[11] Patent Number: 5,157,303

[45] Date of Patent: Oct. 20, 1992

[54] CATHODE RAY TUBE COMPRISING A PHOTODEFLECTOR

[75] Inventor: Rémy Polaert, Villecresnes, France

[73] Assignee: U.S. Philips Corporation, New York, N.Y.

[21] Appl. No.: 574,621

[22] Filed: Aug. 28, 1990

[30] Foreign Application Priority Data

Sep. 22, 1989 [FR] France ..... 89 12474

[51] Int. Cl.[5] ..... H01J 29/74

[52] U.S. Cl. ..... 315/410; 313/439; 250/213 VT

[58] Field of Search ..... 315/410, 10; 313/384, 313/388,-432, 439; 250/213 VT

[56] References Cited

U.S. PATENT DOCUMENTS 3,774,236 11/1973 Schlesinger ..... 313/384

*Primary Examiner*—Theodore M. Blum

*Attorney, Agent, or Firm*—Robert J. Kraus

[57] ABSTRACT

A cathode ray tube includes an electrostatic deflection system along the path of an electron beam $e_f$ and between an electron source and a display screen. The deflection system includes at least an electrostatic photodeflector including a photodetector which, in response to an incident light radiation, creates electric charges $e_p$ which modify the electric deflection field of the photodeflector. The photodeflector may be made up of three electrodes or two electrodes so that the electron beam $e_f$ and the electric charges $e_p$ generated are or are not situated in the same space. The photodetector may be a photocathode or a photodiode. The structure may be repetitive in order to form a distributed photodeflector along the path of the electron beam $e_f$. The cathode ray tube may be used as part of an oscilloscope.

20 Claims, 5 Drawing Sheets

FIG.7A
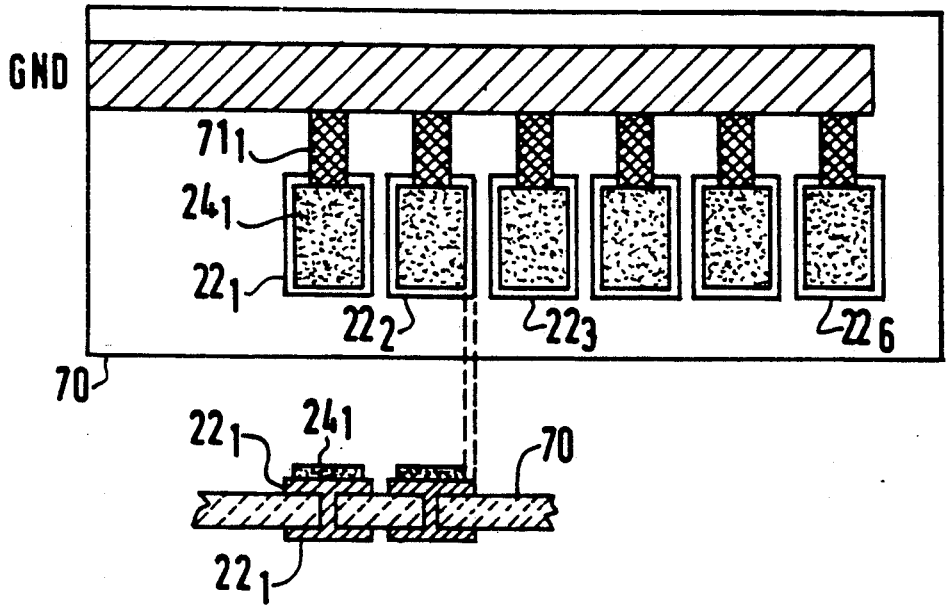
FIG.7B
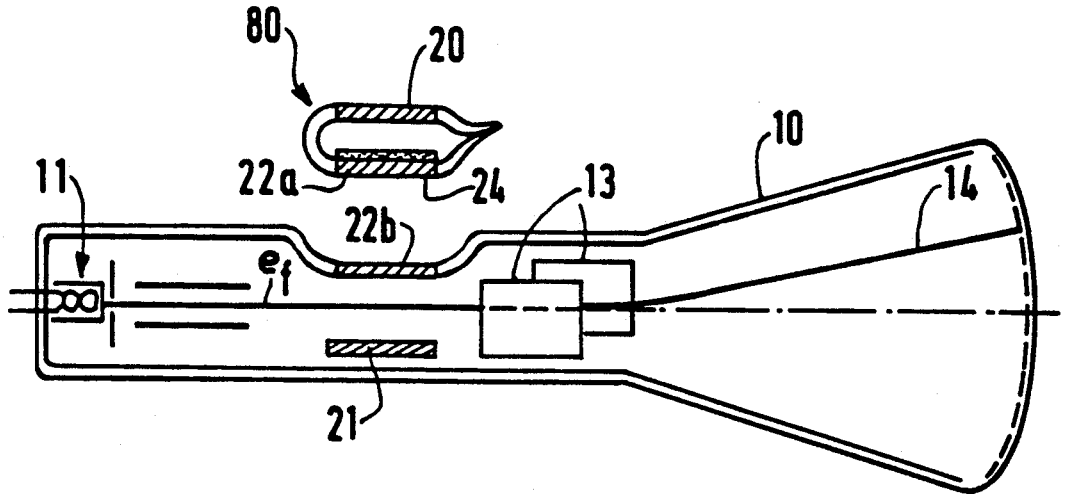
FIG.8

CATHODE RAY TUBE COMPRISING A PHOTODEFLECTOR

BACKGROUND OF THE INVENTION

This invention relates to a cathode ray tube comprising electrostatic deflection means positioned along the path of an electron beam $e_f$ generated by an electron source.

In a cathode ray tube it is usual to deflect the path of the electron beam by means of an electrostatic deflection produced by plates set up at different potentials. The cathode ray tube usually comprises a pair of plates for the horizontal deflection on which a time base is applied and a pair of plates for the vertical deflection on which the electric signal to be analyzed is applied. Said electric signal is introduced into the tube by means of connectors and cables which are connected to a signal generator. Said signals may be generated at first in forms which are non-electric. A conversion into an electric signal is thus necessary, which may be inconvenient or difficult in certain situations.

Said signals may have various frequencies. For rapid or high frequency signals it may be desired to realise, for example, an oscilloscope having a passband which covers several hundreds of MHz. This is, however, difficult to realise with such electrostatic deflection means. Solutions have been suggested using wave propagation techniques.

The document entitled "Les tubes à rayons cathodique à propagation d'ondes à très large bande" by C. Loty, Acte Electronica vol. 10, no. 4, 1966, pp. 351–361, reveals a solution using a wave line in the form of a helix. In this case a wave line of constant division is constituted by a coiled wire conductor along which the wave propagates at the speed of light according to a three-dimensional structure. An oscilloscope based on such a structure has a very high passband. However, the signals which are to be analysed and which act on the electrostatic deflection of the electron beam are to be introduced in an electric form by means of connection cables which have non-negligible capacitances. In practice, there is always the problem of sensitivity and the designer is required to establish a compromise between the speed and the sensitivity of the deflection of the electron beam.

So when light phenomena are analysed which may be of an extremely short duration, a considerable part of the rapid information which they comprise may be concealed and may even be lost by said introduction difficulties of the electric signals in the cathode ray tube, which makes the inconveniences even worse.

So, the solution to the problem posed is to avoid the conversion of optical signals. Moreover, it also may be desired to preserve in the tube a great sensitivity and a high speed for the analysis of such rapid light signals.

SUMMARY OF THE INVENTION

The solution according to the invention is that the electrostatic deflection means comprise at least an electrostatic photodeflector including a photodetector which, under the action of an incident light beam, produces electric charges $e_p$ which modify the electric deflection field of the photodeflector.

Advantageously, the light radiation is not converted into an electric signal before its introduction into the cathode ray tube and so the information which it comprises is better preserved. There is thus direct intervention of the light radiation on the electron beam.

This is very useful not only in devices which are to respond rapidly to the action of the light radiation, but also in devices which are less rapid by taking advantage of the absence of the transformation of the light radiation into an electric signal outside of the said device.

It is a principle of the invention to send the light radiation to be detected directly onto one of the deflection plates via a window placed in the side of the cathode ray tube. Said deflection plate may be covered by a photodetector which depends on the spectral region of the light radiation to be detected. When said photodetector receives light radiation, a quantity of charges is created in proportion to the intensity of the light radiation. When a positive electrode is placed in the proximity thereof, said charges will convey and develop a positive potential on the deflection plate. This constitutes a photodetector placed inside of the cathode ray tube. The deflection plates and the photodetector constitute the photodeflector. The photodetector may be a photocathode which, under the action of an incident light radiation, creates charges in a vacuum, or a photoelectric element, for example, a photodiode, which, under the action of an incident light beam, creates charges in the material of the photoelectric element. So connection cables, connectors and bypasses between the photodetector and the deflection plate of the cathode ray tube are omitted. A greater freedom in the choice of the load impedance Z results.

In particular, it is no longer necessary to have an impedance adapted to that of a connection cable (typically $Z=50\ \Omega$), and it is possible to adopt an impedance of a high value and to augment considerably the vertical detection sensitivity. Thus, if the impedance Z is a resistance of 1000 Ohm accompanied by a stray capacitance of $C=0.1$ pf, a gain in deflection sensitivity is obtained in the ratio $1000/50=20$ for a very short rise time (100 ps) of the photodector.

The photodeflector may comprise three electrodes comprising a first and a second outer electrode between which is interposed a central electrode, the central electrode defining two separated spaces, on one side a first space where the electron beam $e_f$ passes and on the other side a second space where the photodetector is situated.

When the photodetector is a photocathode, according to one embodiment of the invention, the photocathode is provided on the most negative electrode of the electrodes bounding the second space. The electric charges $e_p$ moving from the photocathode towards the positive electrode and the electron beam $e_f$ as it traverses the first space is deflected in a substantially perpendicular direction.

According to other embodiments, it is possible that the central electrode may optionally be set up at an intermediate potential, higher or lower than the potentials of the first and second outer electrodes.

When the photodetector is a photodiode it may be constituted by one piece of silicon placed between the positive outer electrode and the central electrode, the electron beam $e_f$ traversing the space bounded by the central electrode and the negative outer electrode.

Optionally it is also possible to adopt a very high charge resistance, of a quasi-infinite value, for example 10 mOhm, to increase the detection sensitivity. In this case the time constant becomes large with regard to the rise time of the optical signals to be detected and at this time the vetical deflection $V_y$ is no longer proportional to the instantaneous light signal, but to the integral of said signal as a function of the time:

$$V_y = 1/C \int i \, dt.$$

It will be obvious that the deflection sensitivity thus is inversely proportional to the capacitance C, so proportional to the distance between the photodetector and the positive electrode divided by the active surface of the photodetector. Moreover, an increase of said distance photodetector-positive electrode extends the fly time of the electrons, that is to say the actual rise time of said interelectrode space. So there is an optimum distance which is to be determined as a function of the application in view.

In all of the embodiments, notably the embodiments having three electrodes, it is advantageous to reduce the actual capacitance of the photodetector.

When the photodetector is a photocathode, one means to reduce the capacitance between the photocathode and the deflection electrodes consists in omitting one of the electrodes. So there exists a single interelectrode space where the electron beam $e_f$ and the electric charges $e_p$ are active. In this case the photodeflector has two electrodes set up at a positive and negative potential respectively, the photocathode being provided on the face of the negative electrode directed towards the positive electrode. The negative electrode is set up at the negative potential GND by an impedance Z, the electric charges $e_p$ moving from the cathode towards the positive electrode and the electron beam traversing the same interelectrode space in a substantially perpendicular direction.

The light radiation must reach the photodetector to create the electric charges $e_p$. In accordance with the orientation of the light radiation it may be necessary that at least one of the electrodes be transparent to transmit the luminous radiation to the photodetector. It may be a transparent support, for example, a metallized glass, adapted to receive the photocathode. The electrode which faces the photocathode may also be a meshed grid. Or, in the case of a photodiode, the silicon piece may be covered with a transparent metal oxide.

When the photodetector has two electrodes with one space for both the electron beam $e_f$ and the generated electric charges $e_p$, a quiescent permanent deflection will be produced which must normally be compensated. Said quiescent deflection in the rest condition of the track of the electron beam $e_f$ thus is compensated by correction means, for example, correction coils or an electrostatic deflector.

The various embodiments which will be described relate to a photodeflector the basic structure of which comprises three electrodes or two electrodes. Electrode is to be understood to mean herein a plate or an element having an appropriate shape which deflects the electron beam. The fact that the photodetector is incorporated in the deflection means to form a photodeflector makes it possible to increase the reaction speed to a rapid luminous signal. However, it is also possible to increase said reaction speed by realising a distributed photodeflector which comprises several photodetectors arranged along the track of the electron beam $e_f$, the light radiation being successively deflected from one cathode or photodiode to the next by means of reflectors. The best results are obtained when the distances which separate the photocathodes or the photodiodes of the reflectors on the one hand and the distances which separate two consecutive central electrodes on the other hand are determined so as to ensure a synchronized action on the electron beam $e_f$.

The photodeflector or the distributed photodeflector may be provided inside a single space which has been evacuated and which comprises all the elements of a cathode ray tube. However, in the case of a three-electrode embodiment, in order to facilitate the industrial manufacture, it is possible to insulate the space comprising the photodeflector from the space comprising the other elements of the cathode ray tube. So, when it concerns a photocathode it is possible to independently produce the thermal treatments which are necessary for the formation of the photocathode on the one hand and of the cathode of the electron beam (electron source) on the other hand so that they are not mutually damaged thereby. After the assembly of the CRT said two spaces may remain noncommunicating but form one assembly mechanically after they have been adapted in position.

BRIEF DESCRIPTION OF THE DRAWING

The invention will now be described in greater detail with reference to the embodiments and the examples shown in the accompanying drawings, in which:

FIGS. 7A, 7B show an example of an embodiment of the distributed photodeflector according to the electric circuit diagram of FIG. 5A;

FIG. 8 shows an example of an embodiment of a cathode ray tube according to the invention formed with two separate spaces.

DESCRIPTION OF PREFERRED EMBODIMENTS

Figure 1:
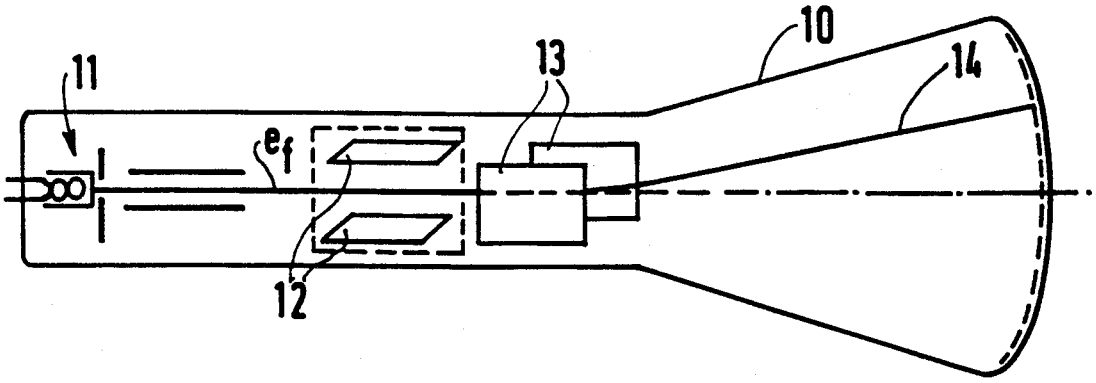
FIG. 1 shows a known cathode ray tube.

FIG. 1 shows a prior-art cathode ray tube. It comprises an evacuated space 10 in which an electron gun 11 emits an electron beam $e_f$ which is deflected (beam 14) by vertical deflection plates 12 and horizontal deflection plates 13. The deflection plates may be formed by helical lines according to the prior art to increase the speed of deflection of the beam. The rapid electric signals to be analysed are introduced by electrical connectors, not shown.

According to the invention at least one of the deflection means is replaced by a photodeflector.

Figure 2A:
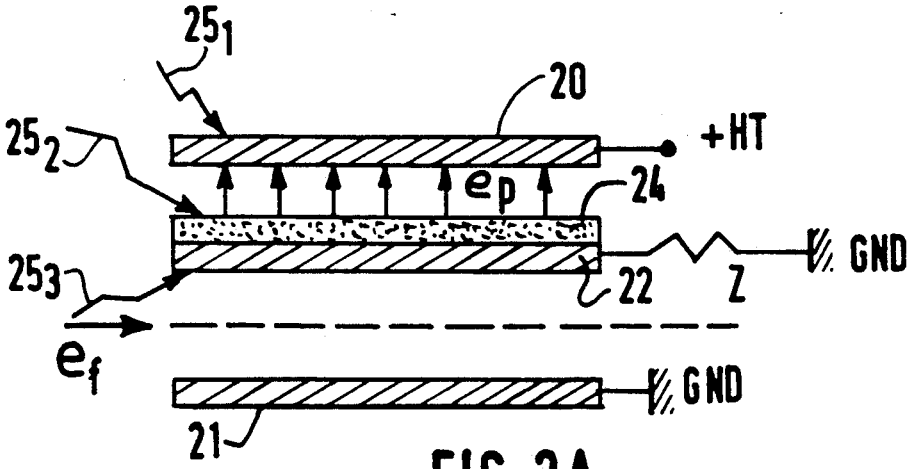
FIGS. 2A, 2B are two diagrams of a photodeflector having three electrodes and provided with a photocathode according to the invention.

FIG. 2A shows a photodeflector having three electrodes comprising a first outer electrode 20, a second outer electrode 21 and a central electrode 22. The electron beam $e_f$ passes in the space between the electrodes 21 and 22. The first outer electrode 20 is set up at a positive potential HT, the second outer electrode 21 is set up at a negative potential GND, and the central electrode 22 is set up at an intermediate potential. On the most negative electrode of the electrodes 20 and 22, i.e., the central electrode, a photocathode 24 is deposited on the side thereof facing the electrode 20. The central electrode 22 is connected to the negative potential GND by a load impedance Z. Under the influence of the light radiation $25_1$, $25_2$, $25_3$ the photocathode emits electrons ($e_p$) which are captured by the first outer electrode 20. Under the influence of the electric current thus created the potential of the central electrode 22 varies and the electric deflection field between the electrodes 21 and 22 also varies, which permits of deflecting the electron beam $e_f$.

Figure 2B:
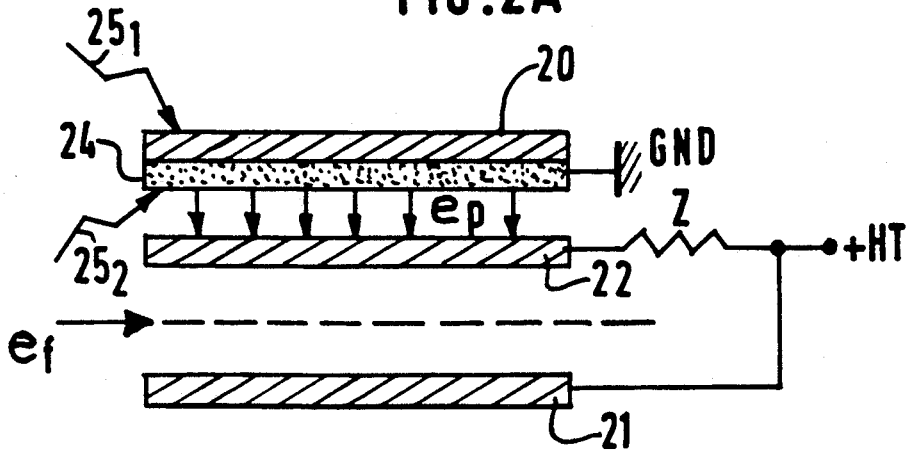

FIG. 2B shows another arrangement of the elements of a photodeflector having three electrodes. The first outer electrode 20 is set up at a negative potential GND, the second outer electrode 21 is set up at a positive potential HT, and the central electrode 22 is set up at an intermediate potential, being connected to the positive potential HT via a load impedance Z. The electron beam $e_f$ passes between the electrodes 21 and 22. The photocathode is deposited on the negative electrode 20 opposite to the central electrode 22 which is at a more positive potential. The same mechanism as described hereinbefore is produced for deflecting the beam.

In other embodiments the central electrode may be set up at a potential lower or higher than the potentials of the first and second outer electrodes, with the photocathode deposited on the more negative electrode of the electrodes 20 and 22.

Figure 3:
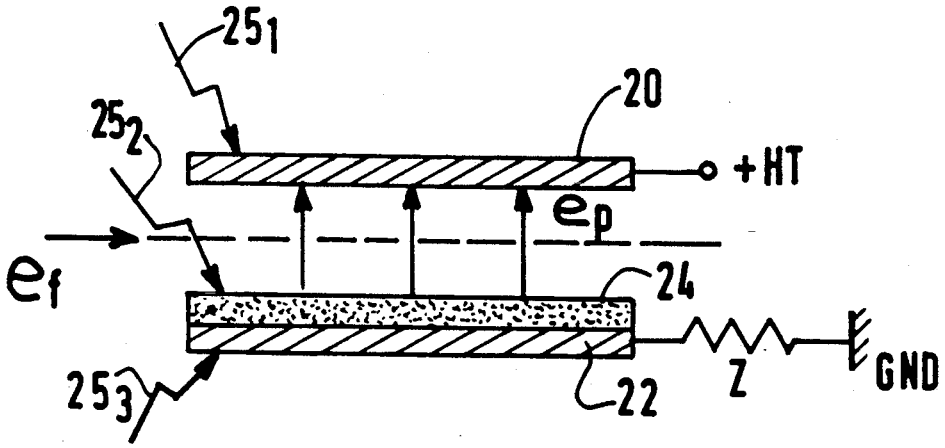
FIG. 3 is a diagram of a photodeflector having two electrodes and provided with a photocathode according to the invention.

FIG. 3 shows a photodeflector having two electrodes. The electron beam $e_f$ and the electric charges $e_p$ move in the same interelectrode space. The photocathode 24 is deposited on the electrode 22 which is connected to the negative potential GND via impedance Z. In this case the direct voltage of polarization between the photocathode and the positive electrode causes the electron beam $e_f$ to be strongly deflected at rest. Said quiescent deflection must be compensated for by correction means:

either by inclining a priori the electron beam before it enters the photodeflector, or by placing a second electrostatic deflector operating in the opposite direction and placed either above or below the photodeflector, or by using a magnetic deflector suitably arranged so that the track of the beam will be formed at the desired area on the screen.

Figure 4A:
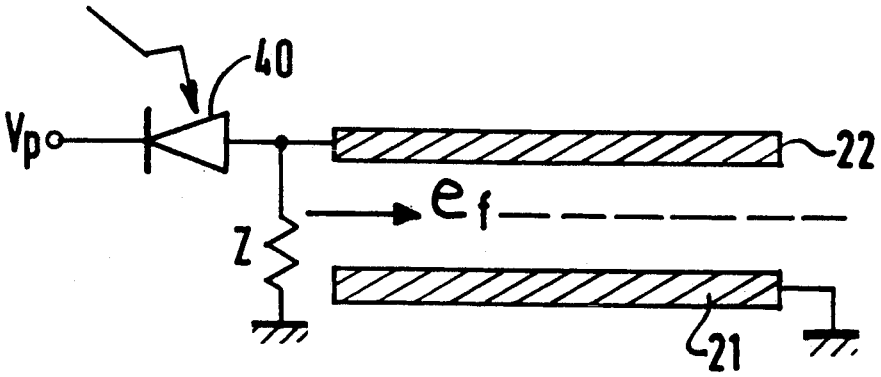
FIGS. 4A, 4B are diagrams of a photodeflector comprising a photodiode.
Figure 4B:
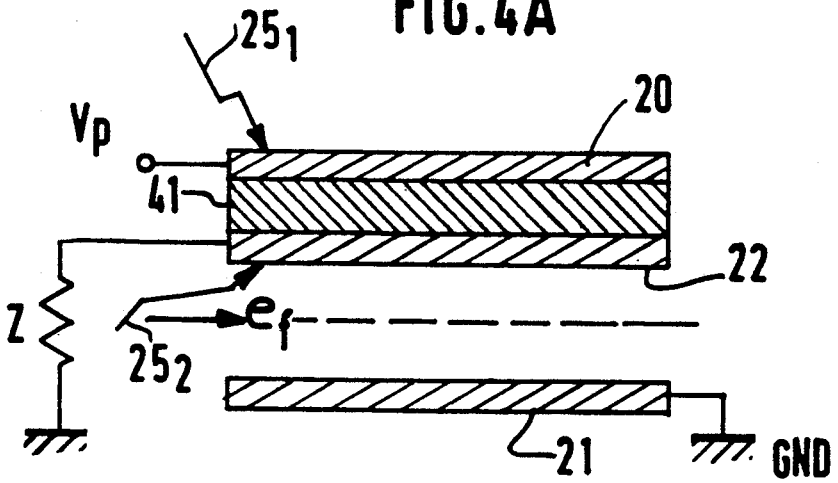

FIG. 4A shows the principal electric diagram of a photodeflector comprising a photodiode. The photodiode 40 is connected on the one hand to a positive potential $V_p$ (lower than the high voltage HT in the case of a photocathode) and on the other hand to the central electrode 22 connected to ground via an impedance Z. The electron beam $e_f$ passes between the central electrode 22 and the second outer electrode 21 set up at a negative potential. FIG. 4B shows a diagram of a tangible implementation of the photodeflector of FIG. 4A. The photodiode is formed from one piece of silicon 41 placed between the first outer electrode 20 set up at a positive potential and the central electrode 22. In order to capture the light radiation $25_1$, $25_2$, at least one of the electrodes must be transparent.

Figure 5A:
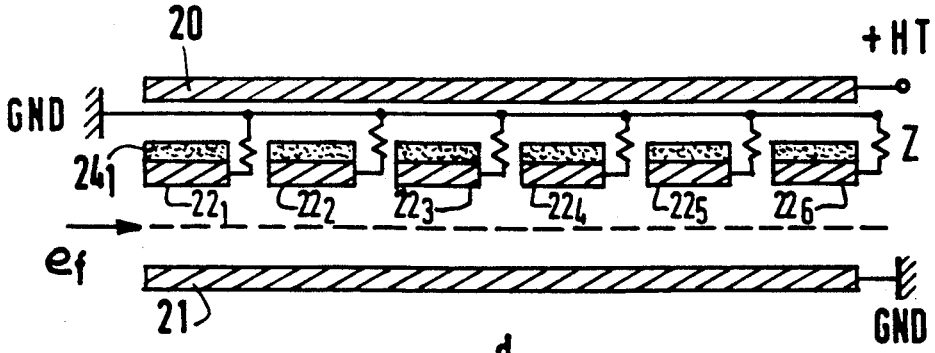
FIGS. 5A to 5D are diagrams of an embodiment of a distributed photodeflector.

FIG. 5A is an electric circuit diagram of a distributed photodeflector. It comprises a first outer electrode 20 set up at a positive potential, a second outer electrode 21 set up at a negative potential and a number of central electrodes $22_1$ to $22_6$. Each of the said central electrodes has a photocathode, for example, $24_1$ for the electrode $22_1$. Each central electrode is connected to the negative potential GND via an impedance Z.

Figure 5B:
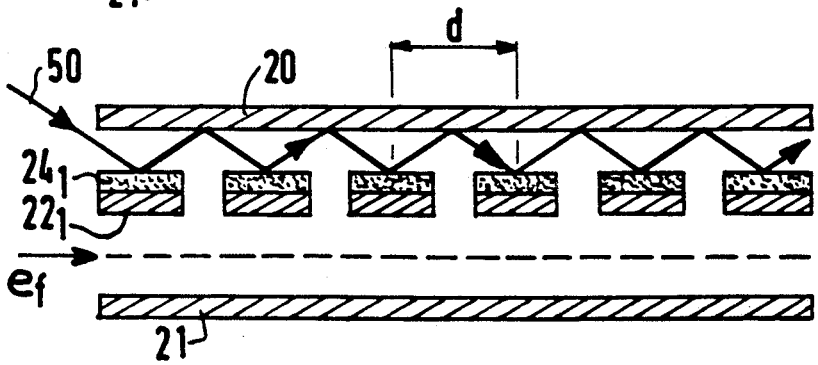

FIG. 5B shows the optical track followed by the light radiation 50. It begins by impinging on the first photocathode $24_1$. A part of the radiation is absorbed and generates electrons (electric charges $e_p$) which act on the potential of the central electrode $22_1$ according to the mechanisms already described. The other part of the radiation is deflected towards the first outer electrode 20 which reflects it in turn towards the second photocathode, and so on. The light radiation is thus absorbed after its action on a few photocathodes. In order to keep the advantage of the distributed photodeflector, it is desirable to divide the absorption of the light radiation among all the photocathodes concerned without favoring the first ones by adapting their absorption rates.

However, in order for the actions of all the individual photodeflectors to be in phase, it is necessary to determine the distance d separating two consecutive individual photodeflectors to adapt the optical path, followed by the light radiation between two consecutive photocathodes, to the distance separating a photocathode (for example, $24_1$) from the first outer electrode 20. The speed of the electrons being:

$$V(\mathrm{m/s}) = (2\ \mathrm{e.V/m})^{\frac{1}{2}} = 5.932 \times 10^5 \cdot (\mathrm{V})^{\frac{1}{2}}$$

where e is the electric charge, m is the electron mass,

V is the applied potential.

The distances d between the photocathodes are thus determined as a function of the applied potential.

Figure 6A:
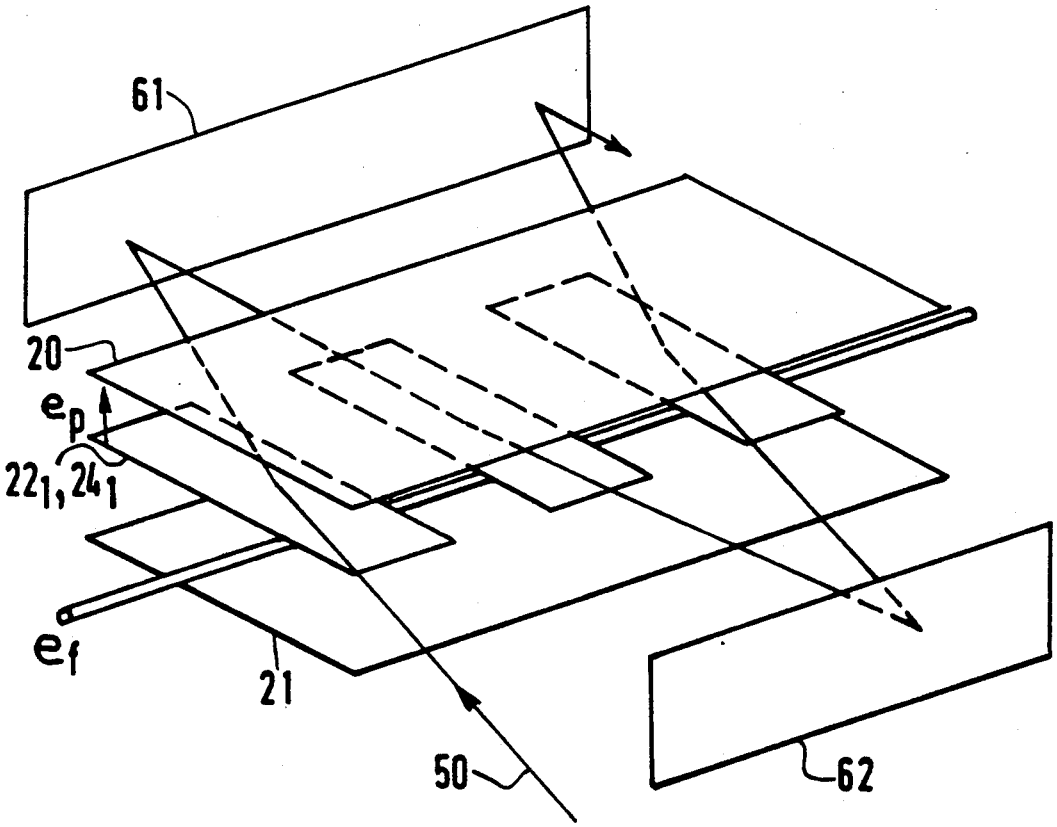
FIGS. 6A, 6B show an example of an embodiment of the distributed photodeflector according to the perspective diagram of FIG. 5B.
Figure 6B:
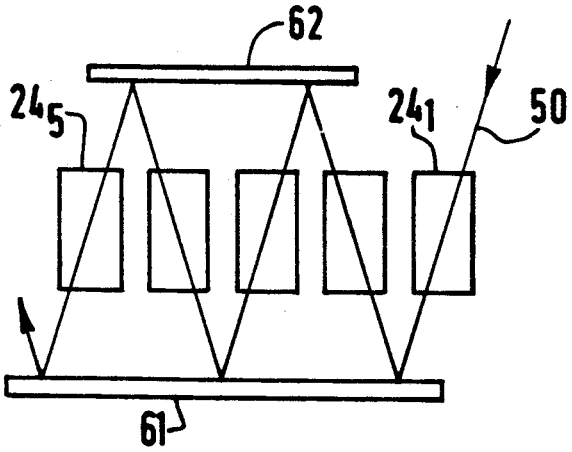

For elongating the optical path it is possible, to use instead of the first outer electrode 20, lateral deflectors 61, 62 such as that shown in FIGS. 6A and 6B.

Figure 5C:
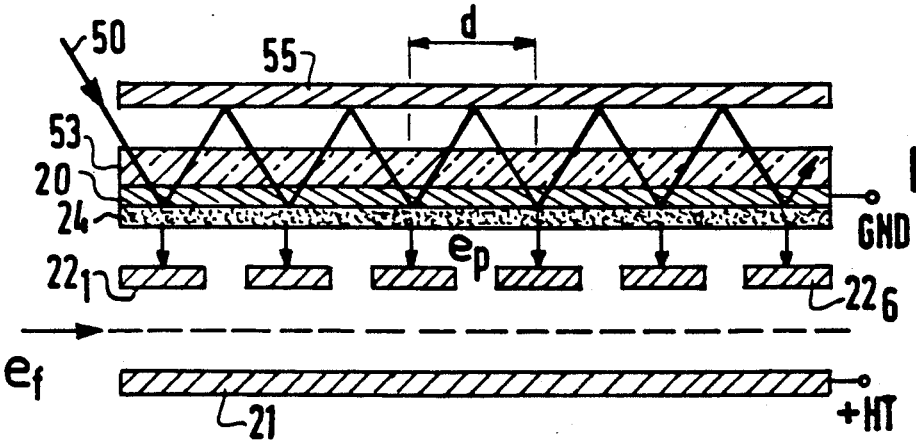

In order to elongate the optical path followed by the light radiation it is also possible to realise a distributed photodeflector as shown in FIG. 5C. Each central electrode $22_1$–$22_6$ is set up at the negative potential by an impedance Z (see FIG. 5A). In this case the photocathode 24 is deposited on a transparent support 53 but is separated therefrom by the semitransparent first outer electrode 20 set up at a negative potential. The electron beam $e_f$ passes between said central electrodes and the second outer electrode 21 set up at a positive potential. Thus the light radiation 50 traverses the transparent support 53 and the semitransparent electrode 20, is partially absorbed and is reflected by the photocathode 24, again traverses the same elements and is then reflected again by a reflector 55. The successive reflection mechanisms are then produced in the same manner as hereinbefore. In this case the optical path may be adapted to the distance d by the positioning of the reflector 55.

Figure 5D:
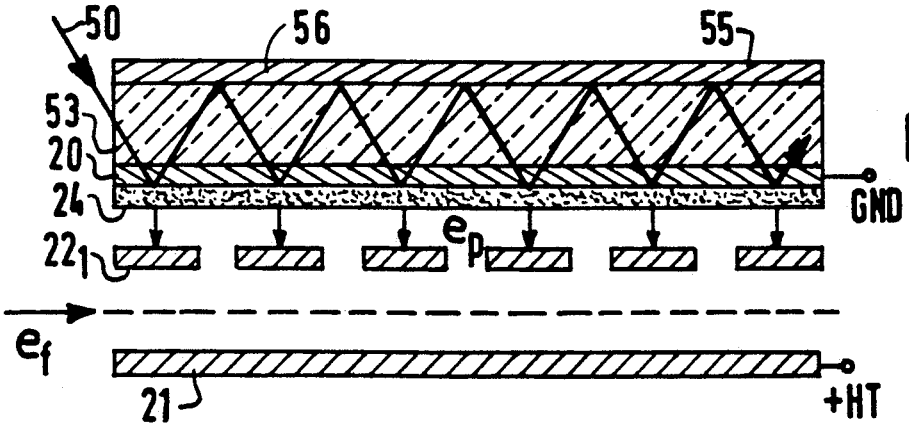

It is also possible to modify the FIG. 5C diagram by, as shown in FIG. 5D, to ensure that the transparent support 53 is sufficiently thick so that the light radiation does not leave the support 53 through its face 56 in the direction of the reflector 55, so as to have a sufficiently long optical path. The reflection may be effected either on the reflector 55 when such a reflector is joined to the support 53, or without a reflector 55 by the face 56 itself by total reflection. The thicknesses and the positionings of the said different elements depend on the characteristics of speed which it is desired to give to the distributed photodeflector.

FIGS. 6A, 6B show an example of an embodiment of a photodeflector according to the FIG. 5B diagram but with lateral reflectors 61, 62.

The light radiation 50 arrives in a direction differing considerably from the direction of propagation of the electron beam $e_f$. The light radiation strikes the first photocathode $24_1$, which is deposited on the first central electrode $22_1$, and is partially absorbed and generates electric charges $e_p$ which are captured by the first outer electrode 20. The other part of the light radiation is reflected by the lateral reflector 61 which sends the radiation towards the second photocathode. At each photocathode the radiation which is not absorbed is thus reflected towards the following photocathode, alternatively by one and the other lateral reflector. FIG. 6B is a plan view of the photodeflector of FIG. 6A where the outer electrodes have been omitted to avoid complexity of the drawing. The same elements are referred to by the same reference numerals.

The central electrodes $22_1$ to $22_6$ shown in FIG. 5 constitute independent conductive surfaces each connected to the negative potential GND via an impedance Z. The electric potential of each central electrode is thus brought under the control of the electric charges $e_p$ which are produced by each photocathode. It is possible to realize said plurality of conductive central electrodes in different ways. FIGS. 7A and 7B show an example of another embodiment. For this purpose an insulating support 70 is used on which the central electrodes $22_1$ to $22_6$ are provided separately and consecutively in the direction of propagation of the electron beam $e_f$ (not shown). Each central electrode traverses the insulating support 70 in a manner such that it appears on the two faces of the support. The upper face (in FIG. 7B) receives the photocathode and the lower face serves to deflect the beam. Each photocathode (for example, $24_1$) is connected via an impedance Z (for example, $71_1$) to the negative potential GND. The conductive electrodes as well as the impedances Z may be realised by conventional thin layer technologies or thick layer technologies. The photocathodes are deposited by conventionally used methods.

The other arrangements described with the photocathodes deposited on the negative electrodes may use the same methods for the realisation.

FIG. 8 shows an example of an embodiment of a cathode ray tube comprising a photodeflector having three electrodes according to the invention. The same essential elements as already described in FIG. 1 are found again, but one of the deflectors is in this case replaced by a photodeflector.

The cathode ray tube shown is formed by two evacuated independent spaces 10 and 80.

The space 80 is formed by an evacuated envelope. It comprises the first outer electrode 20 and the central electrode $22_a$ comprising the photocathode 24. Thus the space 80 may be treated independently for all the processes required for the formation of the photocathode and which could otherwise cause a slight pollution of the other parts of the cathode ray tube. The space 80 may include the window which serves to introduce the light radiation into it.

The space 10 comprises the second outer electrode 21 as well as another central electrode $22_b$ which is accessible from the exterior. Thus, during the assembly of the CRT the central electrodes $22_a$ and $22_b$ are electrically connected together (for example soldered) and constitute the single central electrode 22 of the photodeflector. The central electrode $22_b$ of the evacuated space 10 may be placed in a reentrant part of the evacuated space 10 in order to reduce the distance by which it is separated from the electron beam $e_f$, and hence reduces the capacitances, and to facilitate the positioning of the evacuated space 80.

It will be obvious that it is not necessary to use an arrangement with two separate spaces, but instead to place all of the elements in the evacuated space 10. The embodiments of the photodeflector described hereinbefore may be mounted in a cathode ray tube according to similar principles which are well known to those skilled in the art without departing from the scope of this invention.

Such a cathode ray tube may be used to realize an oscilloscope.

I claim:

1. A cathode ray tube comprising:

an evacuated housing, a source of electrons mounted within the housing near one end thereof for generating an electron beam $e_f$, a display screen mounted within the housing near the other end thereof, and electrostatic deflection means along the path of the electron beam $e_f$ and between the electron source and the display screen, and wherein said deflection means comprise at least an electrostatic photodeflector including a photodetector which in response to incident light radiation thereon creates electric charges $e_p$ which modify the electric deflection field of the photodeflector so as to deflect the electron beam $e_f$ along its path before it strikes the display screen.

2. A cathode ray tube as claimed in claim 1, wherein the photodeflector comprises a first and a second outer electrode between which a central electrode is interposed, a first space through which the electron beam $e_f$ passes, being defined by the central electrode and the second outer electrode, and a second space which comprises the photodetector being defined by the central electrode and the first outer electrode.

3. A cathode ray tube as claimed in claim 2, wherein the photodetector includes a photocathode deposited on the electrode which is the most negative of the electrodes defining the second space, the electric charges $e_p$ moving in a direction from the photocathode towards the positive electrode and the electron beam $e_f$ traversing the first space in a substantially perpendicular direction to the direction of movement of the electric charges $e_p$.

4. A cathode ray tube as claimed in claim 2 or 3, wherein the first outer electrode is set up at a negative potential, the second outer electrode is set up at a positive potential and the central electrode is set up at an intermediate potential.

5. A cathode ray tube as claimed in claim 2 or 3, wherein the first outer electrode is set up at a positive potential, the second outer electrode is set up at a negative potential, and the central electrode is set up at an intermediate potential.

6. A cathode ray tube as claimed in claim 2 or 3, wherein the central electrode is set up at a potential higher than the potentials of the first and the second outer electrodes.

7. A cathode ray tube as claimed in claim 2 or 3, wherein the central electrode is set up at a potential which is lower than the potentials of the first and the second outer electrodes.

8. A cathode ray tube as claimed in claim 1, wherein the photodeflector comprises two electrodes set up respectively at a positive and a negative potential, a photocathode being deposited on a face of the negative electrode directed towards the positive electrode, the negative electrode being set up at the negative potential GND via an impedance Z, the electric charges $e_p$ moving from the photocathode towards the positive electrode and the electron beam traversing the same inter-electrode space in a substantially perpendicular direction to the electric charges.

9. A cathode ray tube as claimed in claim 8, wherein the quiescent deflection of the path of the electron beam $e_p$ is compensated for by correction means.

10. A cathode ray tube as claimed in claim 1 or 2, wherein the photodetector comprises a photodiode.

11. A cathode ray tube as claimed in claim 2, wherein the photodetector comprises a photodiode including a silicon piece located between the positive outer electrode and the central electrode, the electron beam $e_f$ traversing the space defined by the central electrode and the negative outer electrode.

12. A cathode ray tube as claimed in claims 2 or 3, wherein the electron beam $e_f$ is deflected by the combination of an electric signal applied to at least one of the electrodes with an optical signal applied to the photodetector.

13. A cathode ray tube as claimed in claim 2 or 3, wherein at least one of the electrodes is transparent to transmit the light radiation to the photodetector.

14. A cathode ray tube as claimed in claim 13, wherein the transparent electrode comprises a meshed grid.

15. A cathode ray tube as claimed in claim 1, 2 or 3 which comprises several photodeflectors forming a distributed photodeflector along the path of the electron beam $e_f$, the light radiation being successively deflected from one photocathode or one photodiode to the next reflector means.

16. A cathode ray tube as claimed in claim 15, wherein the reflector means comprise reflectors and the distances which separate the photocathodes or the photodiodes from the reflectors, and the distances which separate two consecutive central electrodes, are chosen so as to ensure a synchronized action on the electron beam $e_f$.

17. A cathode ray tube as claimed in claim 1, 2 or 3, which comprises a first evacuated space which includes the photodeflector and a second evacuated space formed integrally with the first space and which comprises the other elements of the cathode ray tube.

18. A cathode ray tube as claimed in claim 17, wherein prior to assembly the first evacuated space forms an independent element.

19. A cathode ray tube as claimed in claim 15 wherein at least one of said electrodes also functions as said reflector means.

20. A cathode ray tube as claimed in claims 1, 2 or 3 wherein said electrostatic photodeflector comprises the vertical deflection means in said cathode ray tube whereby the electron beam is vertically deflected as a function of said incident light radiation, and said cathode ray tube further comprises an electrostatic horizontal deflection means along the path of the electron beam $e_f$ and in cascade with said electrostatic photodeflector.

* * * * *